US007354143B2

(12) United States Patent
Nishida et al.

(10) Patent No.: US 7,354,143 B2
(45) Date of Patent: Apr. 8, 2008

(54) INKJET RECORDING APPARATUS

(75) Inventors: Katsunori Nishida, Aichi-ken (JP); Shota Iijima, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 284 days.

(21) Appl. No.: 11/070,802

(22) Filed: Mar. 2, 2005

(65) Prior Publication Data

US 2005/0195251 A1 Sep. 8, 2005

(30) Foreign Application Priority Data

Mar. 4, 2004 (JP) ..... 2004-060395

(51) Int. Cl.
*B41J 2/175* (2006.01)
*B41J 2/14* (2006.01)

(52) U.S. Cl. ..... 347/85; 347/49

(58) Field of Classification Search ..... 347/49, 347/85, 86, 87

See application file for complete search history.

(56) References Cited

U.S. PATENT DOCUMENTS

| | | | | |
|---|---|---|---|---|
| 5,949,459 | A * | 9/1999 | Gasvoda et al. | 347/86 |
| 5,992,988 | A | 11/1999 | Haigo | |
| 6,010,213 | A | 1/2000 | Kanaya et al. | |
| 6,048,055 | A * | 4/2000 | Hakkaku | 347/86 |
| 6,390,611 | B1 * | 5/2002 | Kobayashi et al. | 347/84 |
| 6,450,630 | B2 | 9/2002 | Kanaya et al. | |
| 6,520,630 | B1 * | 2/2003 | Oda et al. | 347/85 |
| 6,585,358 | B2 * | 7/2003 | Usui et al. | 347/85 |
| 6,612,689 | B2 * | 9/2003 | Suenaga et al. | 347/85 |
| 6,726,313 | B1 * | 4/2004 | Oda et al. | 347/85 |
| 2003/0128261 | A1 | 7/2003 | Usui et al. | |

FOREIGN PATENT DOCUMENTS

| | | |
|---|---|---|
| EP | 0956958 A | 11/1999 |
| JP | 05-096744 A | 4/1993 |
| JP | 985963 | 3/1997 |
| JP | 9207347 | 8/1997 |

* cited by examiner

*Primary Examiner*—Anh T. N. Vo
(74) *Attorney, Agent, or Firm*—Day Pitney LLP

(57) ABSTRACT

An inkjet recording apparatus comprises a recording head ejecting ink droplets to perform recording, an ink cartridge, and a mounting portion on which the ink cartridge is detachably mountable. The cartridge has an ink chamber for storing ink, an ink supply port for supplying the ink to the head, and an air introducing port for introducing an atmospheric air into the ink chamber. The mounting portion has an ink supply portion for supplying the ink from the cartridge to the head, and an air introduction portion for supplying the air into the ink chamber. The air introduction portion comprises an air supply port positionally corresponding to the air introducing port of the cartridge as mounted on the mounting portion, an air intake port for taking in the air, and an air supply passage extending between the air supply port and the air intake port and comprising a turn.

15 Claims, 7 Drawing Sheets

INKJET RECORDING APPARATUS

INCORPORATION BY REFERENCE

The present application is based on Japanese Patent Application No. 2004-060395, filed on Mar. 4, 2004, the content of which is incorporated herein by reference.

BACKGROUND OF THE INVENTION

1. Field of the Invention

The invention relates to an inkjet recording apparatus, and particularly to an inkjet recording apparatus having a fluid passage through which air is supplied into an ink cartridge as mounted on the inkjet recording apparatus.

2. Description of Related Art

Disclosed in JP-A-9-207347 corresponding to U.S. Pat. No. 5,992,988, there is known an inkjet recording apparatus where a labyrinthine air communication passage in communication with an air communication port is formed in an ink cartridge to restrict flow of air into and out of the ink cartridge through the air communication port in order to prevent evaporation of ink or water in the ink.

Further, in JP-A-9-85963 corresponding to U.S. Pat. Nos. 6,010,213 and 6,450,630 is disclosed another arrangement where an ink container (or an ink cartridge) is detachably attached to a holder (or a mounting portion). In the holder are formed an air communication passage in which an ink-attracting porous material is accommodated, and an ink supply passage connected to a recording head. Two openings in the ink cartridge are connected to these passages, respectively.

However, in the arrangement of JP-A-9-207347 where the labyrinthine air communication passage is formed in the ink cartridge, to ensure a sufficient length of the air communication passage requires an increase in the volume of the ink cartridge. When the volume of the ink cartridge is decreased, on the other hand, the labyrinthine air communication passage can not have a sufficient length or a desired shape.

Further, in the arrangement of JP-A-9-85963 where upon mounting of the ink cartridge the porous material in the air communication passage absorbs the ink to make the pressure inside the ink cartridge negative, evaporation of the ink at the air communication passage and a variation in compression of the porous material make the negative pressure in the ink cartridge unstable.

SUMMARY OF THE INVENTION

An object of the present invention is therefore to provide an inkjet recording apparatus having a labyrinthine air communication passage for supplying air into an ink cartridge, and capable of solving the above-described problems.

To attain the object, this invention provides an inkjet recording apparatus which comprises a recording head which ejects ink droplets to perform recording, an ink cartridge, and a mounting portion on which the ink cartridge is detachably mountable. The ink cartridge has an ink chamber for storing ink, an ink supply port for supplying the ink to the recording head therethrough, and an air introducing port for introducing an atmospheric air into the ink chamber therethrough. The mounting portion has an ink supply portion for supplying the ink drawn from the ink cartridge to the recording head, and an air introduction portion for supplying the atmospheric air into the ink chamber. The air introduction portion comprises an air supply port disposed to positionally correspond to the air introducing port of the ink cartridge when the ink cartridge is mounted on the mounting portion, an air intake port for taking in the atmospheric air therethrough, and an air supply passage which extends between the air supply port and the air intake port and whose shape comprises a turn.

According to the inkjet recording apparatus constructed as described above, the air supply portion comprises the air supply passage which includes the turn and connects the air intake port for taking in the atmospheric air therethrough with the air supply port disposed at a position corresponding to the air introducing port of the ink cartridge as mounted on the mounting portion. Thus, compared to an arrangement where such an air supply passage is formed in the ink cartridge, the air supply passage can be designed with more freedom with respect to the length and shape of the air supply passage, while the ink cartridge which is an expendable part can be produced at a reduced cost, making it possible to offer the ink cartridge at a lower price.

Further, evaporation of the ink through the air introducing port of the ink cartridge as mounted on the mounting portion can be prevented by the presence of the turn of the air supply passage, enabling a stable supply of the air.

BRIEF DESCRIPTION OF THE DRAWINGS

FIGS. 2A and 2B are cross-sectional views of the ink cartridge and a mounting portion of the inkjet recording apparatus, in which FIG. 2A shows a state before the ink cartridge is mounted while FIG. 2B shows a state after the mounting of the ink cartridge;

FIGS. 3A-3E show details of a valve member 32 in which FIG. 3A is a plan view, FIG. 3B is a side view, FIG. 3C is a cross-sectional view taken along a line 3C-3C in FIG. 3A, FIG. 3D is a cross-sectional view taken along a line 3D-3D in FIG. 3A, and FIG. 3E is a bottom view;

FIGS. 4A-4C show details of a valve member 65, in which FIG. 4A is a plan view, FIG. 4B is a side view, and FIG. 4C is a bottom view;

FIGS. 5A-5D show details of a mounting portion, in which FIG. 5A is a cross-sectional view taken along a line 5A-5A, FIG. 5B is a bottom view, FIG. 5C is a cross-sectional view taken along a line 5C-5C in FIG. 5B, and FIG. 5D is a cross-sectional view taken along a line 5D-5D in FIG. 5B; and FIGS. 6A and 6B are cross-sectional views of an ink cartridge and a mounting portion of an inkjet recording apparatus according to a second embodiment of the invention, in which FIG. 6A shows a state before the ink cartridge is mounted, while FIG. 6B shows a state where the ink cartridge is mounted.

DETAILED DESCRIPTION OF PREFERRED EMBODIMENTS

Figure 1:
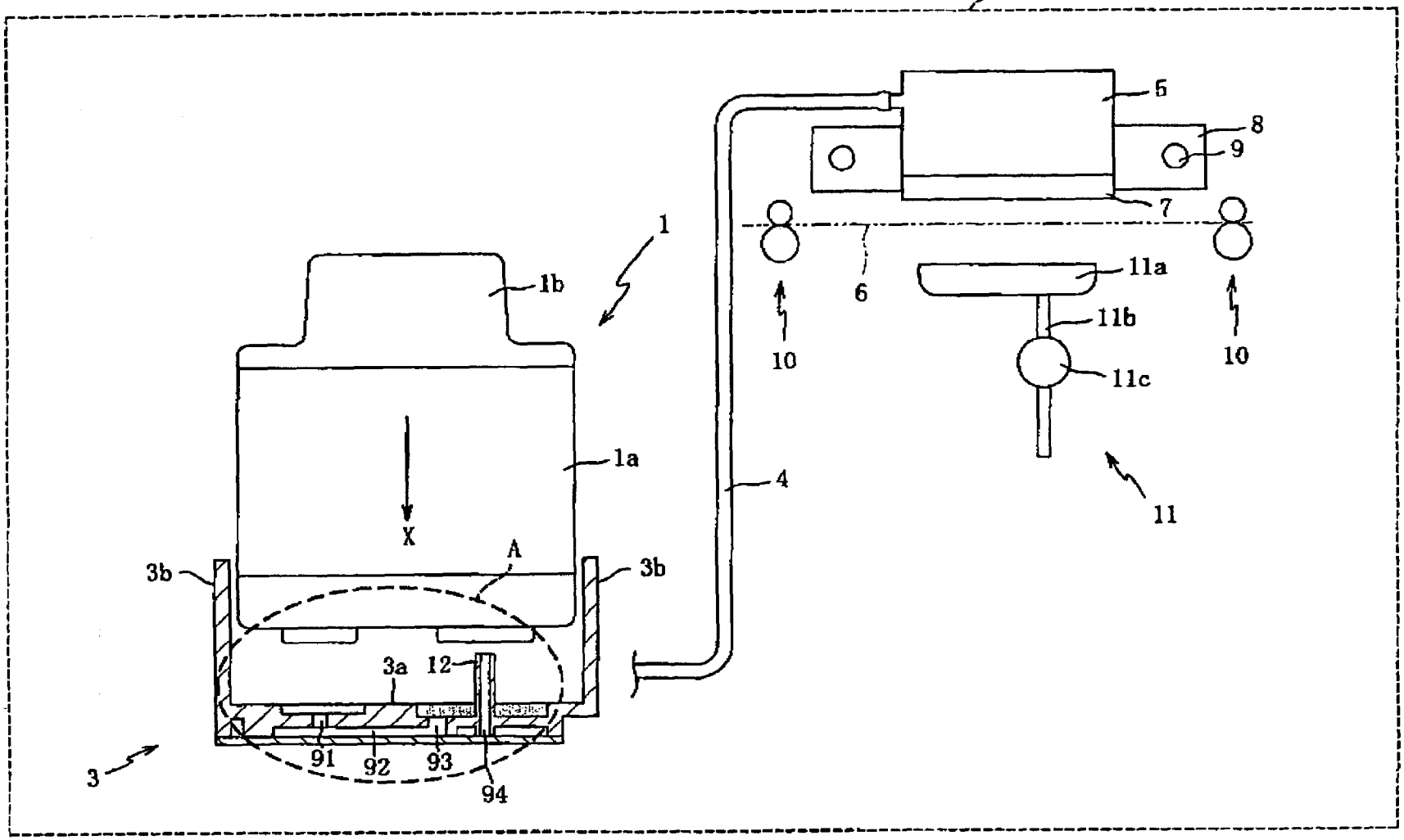
FIG. 1 is a schematic view showing an ink cartridge and an inkjet recording apparatus in which the ink cartridge is mounted, according to one embodiment of the invention.

Hereinafter one preferred embodiment of the invention will be described, by referring to the accompanying drawings. FIG. 1 schematically shows an inkjet recording apparatus in which an ink cartridge according to the embodiment is mounted.

The ink cartridge 1 is detachably attached to the inkjet recording apparatus 2 having a recording head 7 from which ink droplets are ejected. The ink cartridge 1 stores the ink to be supplied to the recording head 7.

The ink cartridge 1 comprises a casing 1*a* of a hollow box open on its upper side, and a lid 1*b* hermetically sealing the open, upper side of the casing 1*a*. The ink to be supplied to the recording head 7 is stored in an ink chamber 16 (shown in FIG. 2) formed inside the casing 1*a*. A plurality of such ink cartridges 1, which are filled with inks of respective colors, namely, cyan, magenta, yellow, and black, are attached to the inkjet recording apparatus 2.

The inkjet recording apparatus 2 comprises a main body, which has a stationary part in which a mounting portion 3, on which the ink cartridges 1 are detachably attached, is disposed, a tank 5 for storing inks supplied via ink supply pipes 4 extending from the respective ink cartridges 1, the recording head 7 for ejecting droplets of the inks stored in the tank 5 toward a recording sheet 6, a carriage 8 on which the tank 5 and the recording head 7 are mounted and which is horizontally reciprocated, a carriage rod 9 guiding the reciprocation of the carriage 8, a feeding mechanism for feeding the recording sheet 6, and a purge device 11.

The mounting portion 3 comprises a base portion 3*a*, and a guide portion 3*b* comprising two segments each standing upright from one of opposite sides of the base portion 3*a*. In the base portion 3*a* between the two segments of the guide portion 3*b*, there are disposed ink drawing tubes 12 protruding from the base portion 3*a* for drawing the inks stored in the ink cartridges 1, and air supply ports 91 for supplying air to the inside of the ink cartridges 1.

One end of each ink drawing tube 12 communicates with an ink supply passage 94, and in turn with the tank 5 via the ink supply pipe 4. Each air supply port 91 is in communication with an air supply passage 92 and an air intake port 93, as shown in FIG. 5.

Each ink cartridge 1 is mounted on the mounting portion 3 in a vertical direction, namely, an X direction as indicated by an arrow in FIG. 1. Upon this mounting, the ink drawing tube 12 opens a first valve device 23 (described later) disposed in the ink cartridge 1 to be brought into communication with the inside of the ink chamber 16. The air supply port 91 is also in communication with the inside of the ink chamber 16.

The recording head 7 has a plurality of nozzles in its surface opposed to the recording sheet 6. When an actuator comprising a piezoelectric element is driven, a droplet of a corresponding one of the inks stored in the tank 5 is ejected toward the recording sheet 6 through a corresponding one of the nozzles. Actual recording on the recording sheet 6 is performed while the carriage 8 is reciprocated with the recording head 7 thereon.

The recording head 7 is disposed on the mounting portion 3, and the ink inside each nozzle is under negative pressure. That is, a head difference between each ink cartridge 1 as mounted on the mounting portion 3 and the nozzles applies a negative back pressure to the ink inside each nozzle.

The purge device 11 is disposed outside a recording area and at a position to be opposed to the recording head 7. The purge device 11 comprises a purge cap 11*a* to cover the surface of the recording head 7 where the nozzles are formed, a waste ink tube 11*b* in communication with the purge cap 11*a*, and a pump 11*c* for sucking the ink from each nozzle via the waste ink tube 11*b*.

When a purge operation is performed, the carriage 8 is moved to a purge position, and the surface of the recording head 7 where the nozzles are formed are covered by the purge cap 11*a*. In this state, the pump 11*c* is driven to suck bad ink containing bubbles and/or others, which is accumulated inside the recording head 7. The sucked bad ink is stored in a waste ink tank not shown, via the waste ink tube 11*b*. The recording and purge operations are controlled by a CPU (not shown) which is incorporated in the inkjet recording apparatus 2.

Figure 2A:
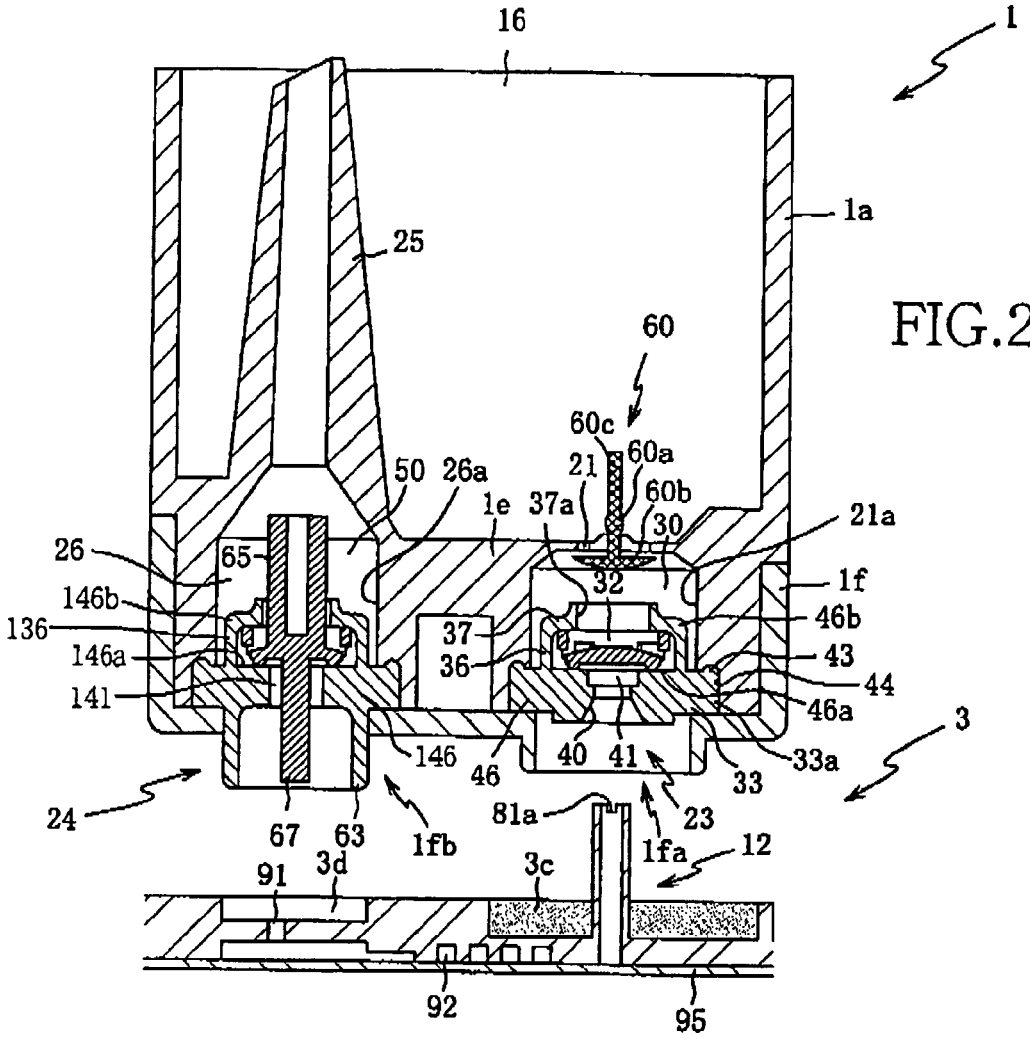
Figure 2B:
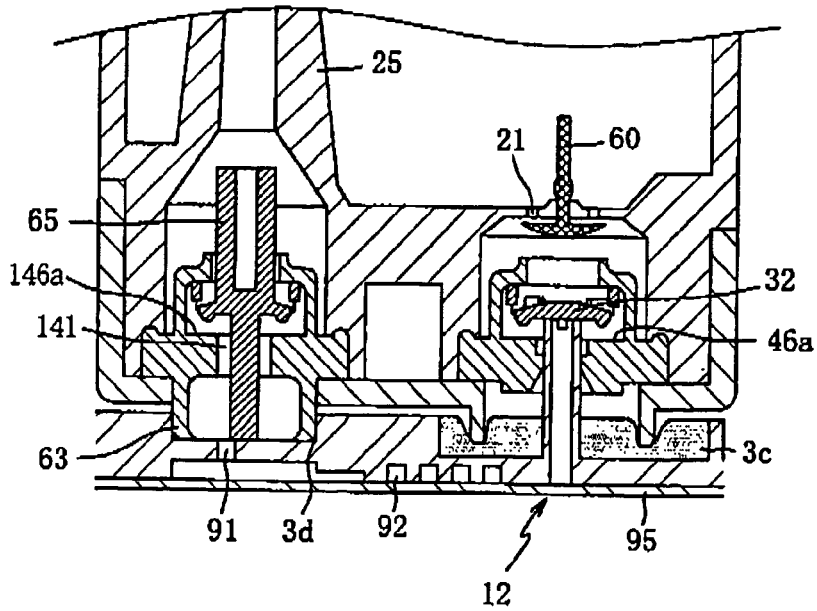
Figure 3A:
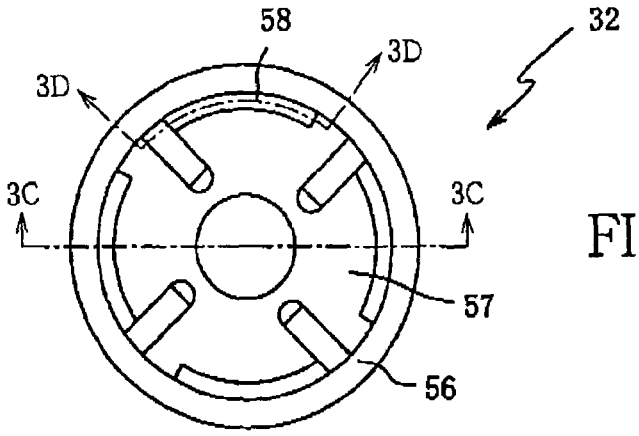
Figure 3B:
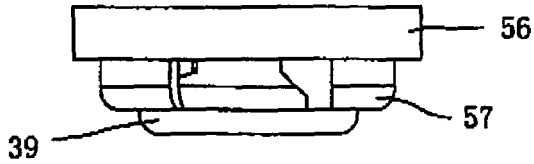
Figure 3C:
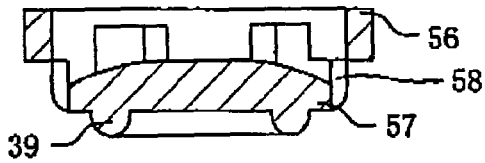
Figure 3D:
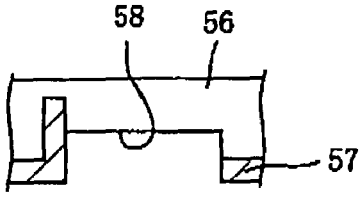
Figure 3E:
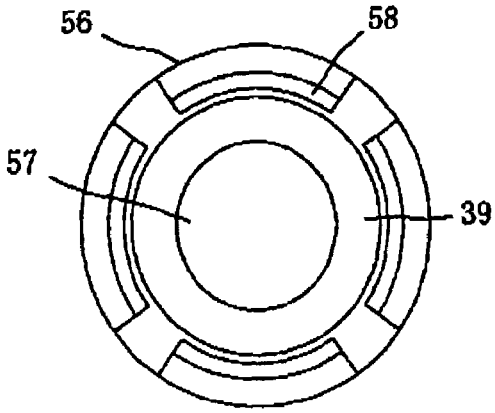

Referring now to FIGS. 2A and 2B, a structure of a joint portion "A" as shown in FIG. 1, that is, a portion where each ink cartridge 1 is joined to the inkjet recording apparatus 2, will be described. FIG. 2A is a cross-sectional view of the joint portion "A" showing a state before the ink cartridge 1 is attached to the inkjet recording apparatus 2, while FIG. 2B shows a state after the ink cartridge 1 is attached.

The ink cartridge 1 comprises the casing 1*a* defining inside the ink chamber 16 and open in its upper side, and the lid 1*b* covering the open upper side, and a cap member 1*f* covering a bottom wall of the casing 1*a*. The cap member 1*f* has two holes 1*fa*, 1*fb* through which the first valve device 23 and a second valve device 24, which will be described later, are exposed to the side of the mounting portion 3. The ink cartridge 1 is formed by welding the lid 1*b* and the cap member 1*f* to the casing 1*a*. The casing 1*a*, lid 1*b* and cap member 1*f* are made of a resin material.

In the bottom wall 1*e*, there is formed an ink supply port 21 open to supply the ink inside the ink chamber 16 to the outside. The ink supply port 21 is connected to a first communication chamber 30 formed inside a cylindrical wall 21*a* which extends from an undersurface of the bottom wall 1*e* and inside the bottom wall 1*e*. There is also formed in the bottom wall 1*e* an air introducing port 26 which is open to the outside to introduce atmospheric air. The air introducing port 26 is connected to a second communication chamber 50 inside a cylindrical inner wall 26*a* formed to extend inside the bottom wall 1*e* from the undersurface of the bottom wall 1*e*. When the ink cartridge 1 is mounted on the mounting portion 3, the ink drawing tube 12 is inserted into the first communication chamber 30.

To the ink supply port 21 is opposed a check valve 60, which comprises a bevel elastic film portion 60*b* opposed to an underside of the ink supply port 21, and an axial portion 60*c* holding at its one end the bevel film portion 60*b*. The elastic film portion 60*b* and the axial portion 60*c* are integrally formed of a synthetic resin. The axial portion 60*c* is inserted through a hole formed in the bottom wall 1*e*, such that a vertical sliding movement of the axial portion 60*c* is permitted. In an original state where the ink cartridge 1 is not mounted on the mounting portion 3, the check valve 60 is at a position such that the elastic film portion 60*b* thereof is separated from the ink supply port 21 with its bulging portion 60*a* held in contact with an upper surface of the bottom wall 1*e*, and therefore outflow of the ink from the ink chamber 16 toward the first valve device 23 is allowed. When the ink cartridge 1 is mounted on the mounting portion 3 and if a flow of the ink from the ink drawing tube 12 toward the ink chamber 16 occurs, the film portion 60*b* is elevated to close the ink supply port 21 to inhibit this reverse ink flow.

A tubular member 25 extends from the bottom wall 1*e* and inside the ink chamber 16, and defines therein an upper portion of the air introducing port 26, so that the air supplied from the outside is guided into an upper space in the ink chamber 16 through an internal passage or the upper portion of the air introducing port 26. An upper open end of the air introducing port 26 is located above the surface of the ink.

The first valve device 23 as closure means is fixed to the first communication chamber 30 on an ink supply side. The second valve device 24 as closure means is fixed to the second communication chamber 50 on an air introduction side.

The valve device 23 comprises an integrally formed support member 46 of a rubber or other elastic materials, and a valve member 32 of a resin material. The support member 46 is formed to have a generally cylindrical outer shape, and comprises a biasing portion 46*b* and a circular bottom wall portion 33 that are integrally formed. An upper surface of the circular bottom wall portion 33 is a valve seat surface 46*a* on which the valve member 32 is seated, and is positioned in an intermediate part of the support member 46 in an axial direction of the support member 46. The biasing portion 46*b* is on one side of the valve seat surface 46*a* near the ink chamber 16. The valve member 32 is accommodated in the biasing portion 46*b* and biased onto the valve seat surface 46*a* by the biasing portion 46*b*.

The circular bottom wall portion 33 has an attaching portion 33*a* which radially outwardly extends, and the first communication chamber 30 has a stepped portion 44 having a larger diameter than the other portion thereof, so that the attaching portion 33*a* is fitted in the stepped portion 44. At a surface of the attaching portion 33*a* to be opposed to a shoulder of the stepped portion 44, there is formed a protrusion 43. The cap member 1*f* is fixed to the casing 1*a* while the attaching portion 33*a* is fitted between the shoulder of the stepped portion 44 and the cap member 1*f* such that the protrusion 43 is deformed by being pressed against the shoulder. This arrangement prevents leakage of the ink from between the circular bottom wall portion 33 of the valve device 23 and an inner wall of the first communication chamber 30.

An opening 41 is formed at the center of the circular bottom wall portion 33 on the side of the valve seat surface 46*a*, while a guiding entrance 40, along which the ink drawing tube 12 is inserted, is formed at the center of the bottom wall portion 33 on the side opposite the valve seat surface 46*a*, such that the guiding entrance 40 and the opening 41 are in communication with each other.

The guiding entrance 40 has, at its uppermost and most narrowed portion, a diameter smaller than an outer diameter of the ink drawing tube 12 so that the ink drawing tube 12 as inserted in the guiding entrance 40 is held in close contact with a surface defining the guiding entrance 40. The opening 41 has a diameter which is larger than the narrowest portion of the guiding entrance 40 as well as the outer diameter of the ink drawing tube 12. A lower portion of the guiding entrance 40 from which side the ink drawing tube 12 is inserted, is tapered to increase its diameter outward.

The biasing portion 46*b* comprises a cylindrical side wall portion 36 extending perpendicularly upwardly from a periphery of the valve seat surface 46*a* toward the ink chamber 16, and an extending portion 37 which extends inwardly, i.e., toward the ink chamber 16, continuously from the side wall portion 36. An opening 37*a* is formed at the center of the extending portion 37.

In a state where the ink cartridge 1 is not mounted, the biasing portion 46*b* biases the valve member 32 toward the valve seat surface 46*a* by an elastic force of the side wall portion 36 and extending portion 37, to hold the valve member 32 in close contact with the valve seat surface 46*a*. When the ink drawing tube 12 enters into the guiding entrance 40 to push the valve member 32 toward the ink chamber 16, the side wall portion 36 is stretched and a shoulder of the extending portion 37 is inclined, thereby forming a clearance for letting in the ink, between the valve member 32 and the valve seat surface 46*a*.

As shown in FIGS. 3A-3E, the valve member 32 comprises a bottom part 57, a side wall part 56, and a communication passage 58. The side wall part 56 is cylindrical and extends perpendicularly upwardly from a periphery of the bottom part 57. The communication passage 58 extends between the bottom part 57 and the side wall part 56.

The bottom part 57 has, at its end face to be opposed to the valve seat surface 46*a*, an annular protrusion 39 protruding toward the valve seat surface 46*a* at a position on an inner side of the communication passage 58 and on an outer side of the opening 41. In the state where the valve member 32 is accommodated in the support member 46, the side wall part 56 is pressed against an undersurface of the extending portion 37 of the biasing portion 46*b* to be held in close contact therewith. Accordingly, the protrusion 39 elastically deforms the upper portion of the bottom wall portion 33 to be held in close contact with the valve seat surface 46*a*.

Similarly to the valve device 23, the valve device 24 on the air introduction side comprises a support member 146 integrally formed of a rubber or other elastic materials, and a valve member 65 of a resin.

The support member 146 comprises a circular valve seat portion 146*a*, a biasing portion 146*b*, and a sealing portion 63. The circular valve seat portion 146*a* and the biasing portion 146*b* have the functions respectively identical to the valve seat surface 46*a* of the circular bottom wall portion 33 and the biasing portion 46*b* of the valve device 23.

Approximately at the center of the valve seat portion 146*a*, an opening 141 is formed, and the cylindrical sealing portion 63 is integrally formed under the valve seat portion 146*a* and around the opening 141. According to this embodiment where the valve device 24 as closure means comprises the valve member 65 and the valve seat portion 146*a* of an elastic material with which the valve member 65 is brought into contact, and the sealing portion is disposed to be continuous from the valve seat portion 146*a*, the valve seat portion 146*a* and sealing portion 63 are formed with a relatively simple structure.

Figure 4A:
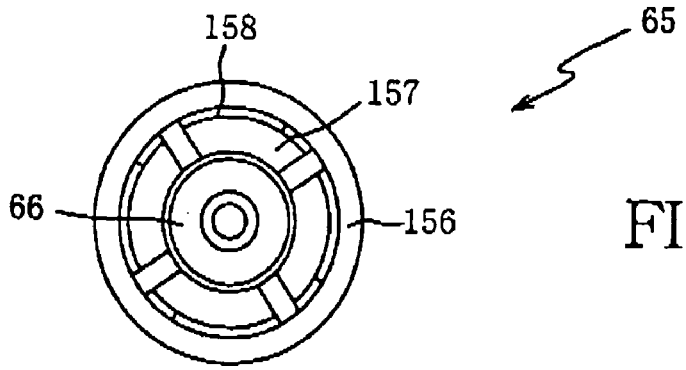
Figure 4B:
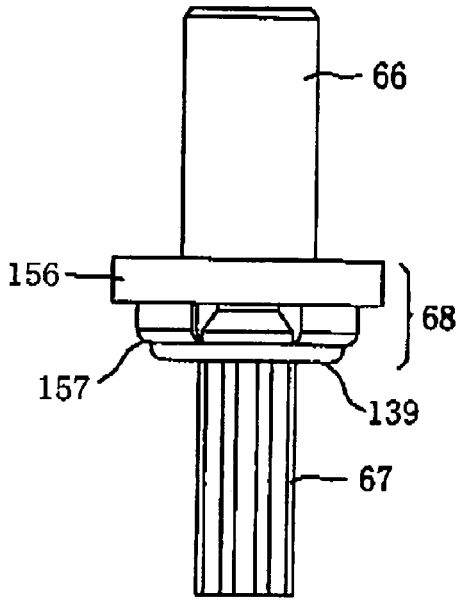
Figure 4C:
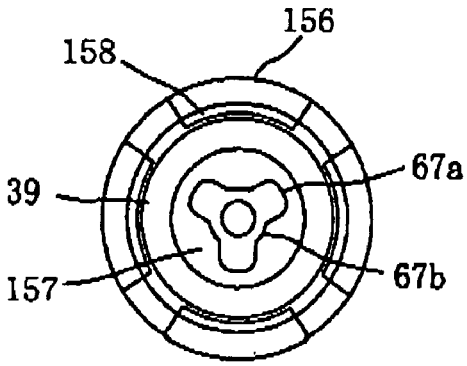

As shown in FIGS. 4A-4C, an upper, lower, and substantially middle portion of the valve member 65 respectively constitute a cylindrical part 66, an operational part 67, and a valve part 68 thereof. Similarly to the valve member 32 shown in FIGS. 3A-3E, the valve part 68 comprises a bottom part 157, a cylindrical side wall part 156 extending perpendicularly upwardly from a periphery of the bottom part 157, and a communication passage 158 extending from the bottom part 157 to the side wall part 156. The functions of these parts 156, 157, 158 are identical to those of the corresponding elements of the valve member 32, and therefore illustration thereof is omitted.

The cylindrical part 66 stands upright from the bottom part 157, and is configured such that when the valve member 65 is moved upward and the valve part 68 is separated from the valve seat portion 146*a* upon attaching the ink cartridge 1 on the mounting portion 3, an upper end of the cylindrical part 66 is spaced from an inner surface of the tubular member 25, thereby ensuring the air communication between the ink chamber 16 and the opening 141 of the valve seat portion 146*a*.

The operational part 67 protrudes perpendicularly downwardly from the bottom part 157. The operational part 67 is generally cylindrical, but recesses 67*b* extending in an axial direction of the operational part 67 are formed in a circumferential surface 67*a* of the operational part 67. The operational part 67 extends downward through the opening 141 of the support member 146, and a lower end of the operation part 67 is located slightly above a lower end of the sealing portion 63. The presence of the recesses 67*b* increases a cross-sectional area of an air passage defined between the operational part 67 and the opening 141.

FIGS. 5A-5D shows details of the mounting portion 3. On the air supply side in the base portion 3*a*, a recess 3*d* is formed at a position to be opposed to the valve device 24. The recess 3*d* has dimensions such that the sealing portion 63 fits in the recess 3*d* when the ink cartridge 1 is attached to the mounting portion 3. On a bottom of the recess 3*d*, the air supply port 91 is formed through a bottom wall constituting the base portion 3*a*, on the inner side of the sealing portion 63 such that the lower end of the operational part 67 does not close an entirety of the air supply port 91. The air supply port is formed through the bottom wall of the base portion 3*a* to be in communication with an end of the groove of the air supply passage, while the ink cartridge is mounted on the side of the bottom wall or base portion 3*a* opposite to the side on which the air supply passage is formed. This arrangement is advantageous in that the mounting portion is relatively simple in structure and can be manufactured relatively easily. The air supply port 91 may be formed in the shape of a slit which has a width smaller than an outer diameter of the operational part 67, and a length larger than the outer diameter of the operation part 67, so that the entirety of the air supply port 91 is not closed by the lower end of the operational part 67 even when this lower end is brought into contact with the air supply port 91. Alternatively, the air supply port 91 may have a radial shape made up of a plurality of such slits as arranged in a radial pattern.

On an undersurface of the base wall constituting the base portion 3*a*, there is formed the air supply passage 92, which is groove shaped. One of opposite ends of the air supply passage 92 is enlarged in cross-sectional area and connected to the air supply port 91. The other end of the air supply passage 92 is connected to the air intake port 93 formed through the bottom wall constituting the base portion 3*a*. According to this embodiment, the air intake port 93 is relatively simple in structure and can be manufactured relatively easily, since the air intake port 93 is formed through the bottom wall of the base portion 3*a* to be in communication with the other end of the groove opposite to the end in communication with the ink cartridge 1. The air supply passage 92 includes a bend portion where the air supply passage 92 turns around a plurality of times on the undersurface of the bottom wall, in order to restrict the air communication with the outside to prevent evaporation of components of the ink including water when the air supply passage 92 is in communication with the air introducing port 26. Accordingly, in this embodiment where the mounting portion 3 is disposed at the stationary part of the main body of the apparatus 2, and the ink supply pipe 4 connects the ink supply side of the mounting portion 3 and the recording head 7, even in a case where the ink cartridge 1 is the one storing a large volume of ink, there is obtained an effect that the ink can be kept supplied excellently with the evaporation of the ink effectively prevented and the air introduced with stability, throughout the entire period of its use.

The air intake port 93 is open in an upper surface of the base portion 3*a*. When the ink cartridge 1 is mounted on the base portion 3*a*, the air intake port 93 is spaced from a bottom face of the ink cartridge 1, so as to enable to supply the atmospheric air into the ink cartridge 1 via the air supply passage 92 and air supply port 91. An upper surface of the air intake port 93 may be covered by an elastic porous material 3*c* (as will be described later), which allows an air communication between the air intake port 93 and the outside.

On the ink drawing side, an ink drawing tube 12 which is formed integrally with the base portion 3*a* protrudes on the upper side of the bottom wall of the base portion 3*a*. On an undersurface of the bottom wall, the ink supply passage 94 is formed. One 94*a* of opposite ends of the ink supply passage 94 is connected to a lower end of an internal passage defined inside the ink drawing tube 12 and extending over an entire length of the ink drawing tube 12. The other end 94*b* of the ink supply passage 94 is open in an upper surface of an extended part of the base portion 3*a* which is located outside the guide portions 3*b*, and the other end 94*b* is connected to the ink supply pipe 4.

A communication opening 81*a* is formed at an upper end of the ink drawing tube 12 so as to allow communication between the internal passage and the ink chamber 16 in a state where the upper end of the ink drawing tube 12 is held in contact with the valve member 32. On the upper surface of the base portion 3*a* and around the ink drawing tube 12, there is disposed the elastic porous material 3*c*, which may be of a sponge material. In the event of leakage of the ink from the valve device 23, the elastic porous material absorbs the leaking ink.

Figure 5A:
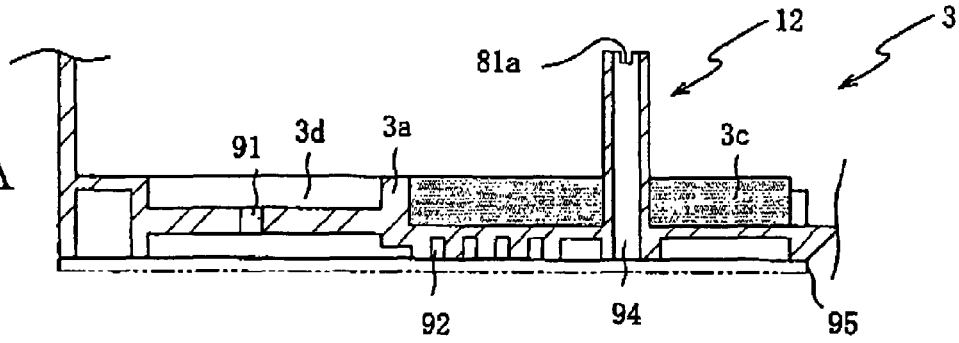
Figure 5B:
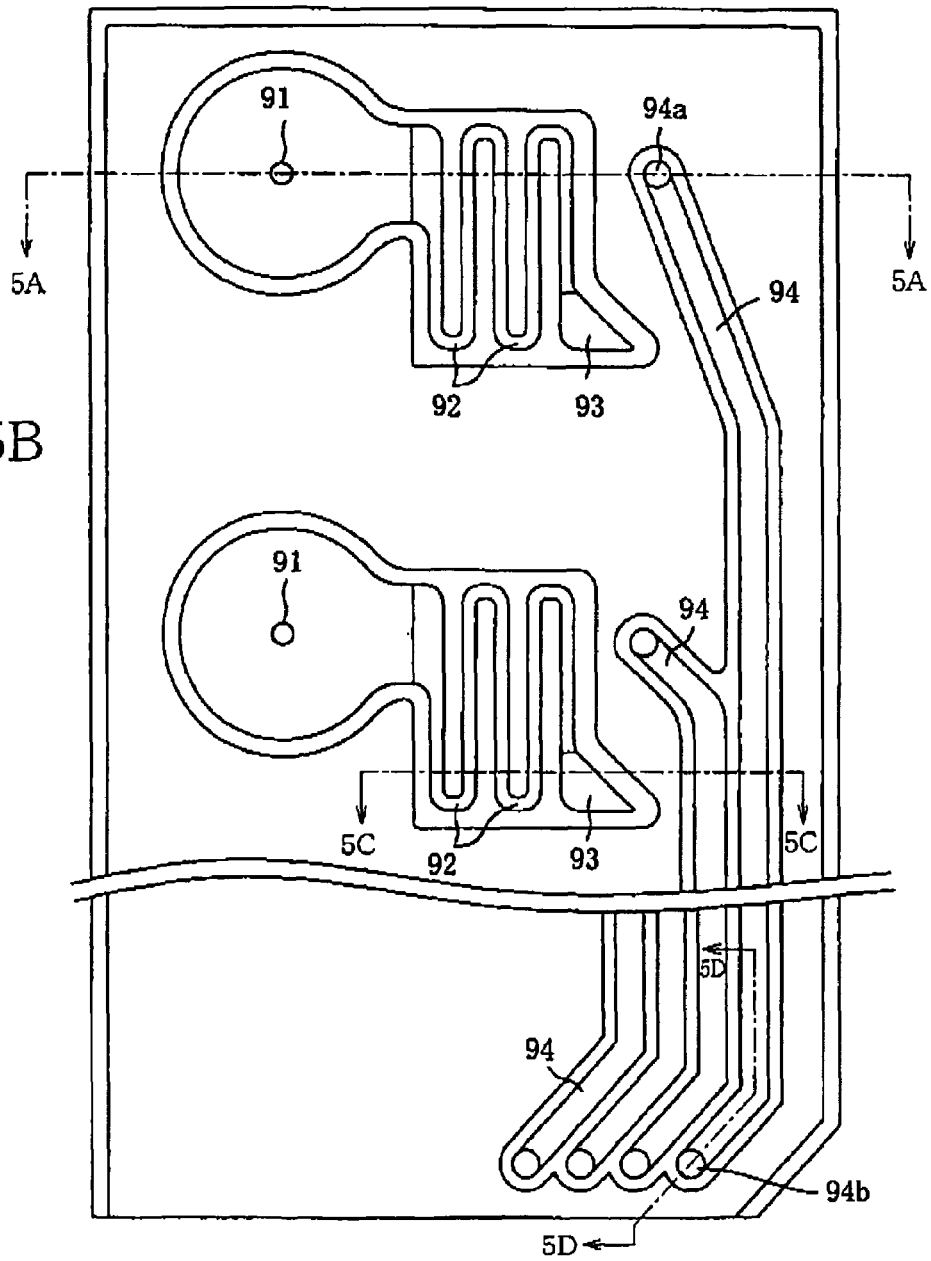
Figure 5C:
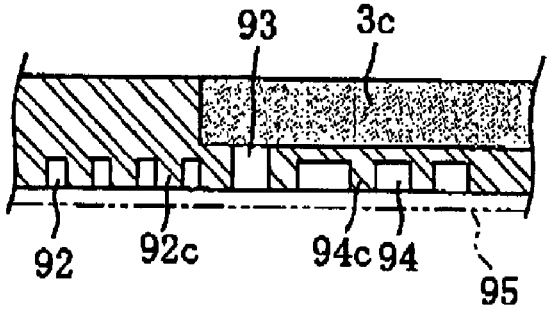
Figure 5D:
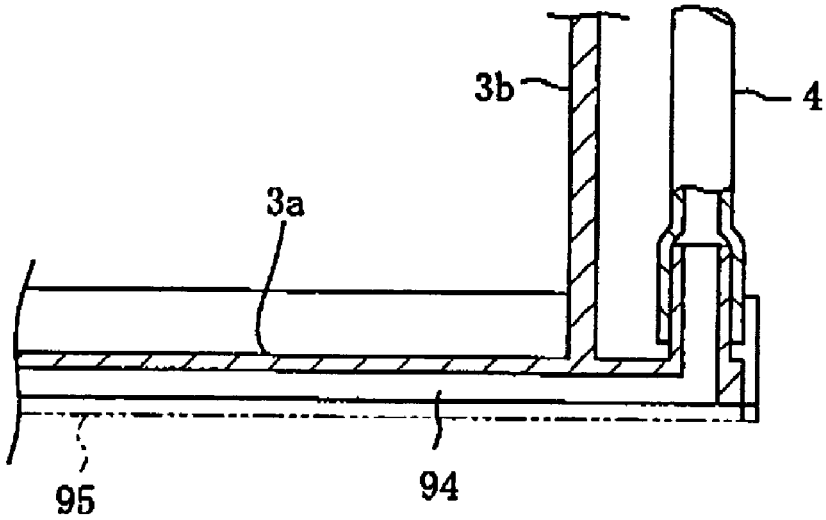

The mounting portion 3 includes a plurality of mounting places arranged in a row, corresponding to the plurality of ink cartridges. The wall members constituting the base portion 3*a* and the guide portions 3*b* are integrally extended in a direction of extension of the row of the ink cartridges. At each of the mounting places, a set of elements comprising the above-described ink drawing tube 12, ink supply passage 94, recess 3*d*, air supply port 91, air supply passage 92, and air intake port 93 is disposed. Each ink supply passage 94 is connected at its one end to the ink supply pipe 4, and these ends of the ink supply passages 94 are arranged in a row in the extended part of the base portion 3*a*, as shown in FIG. 5B.

The ink supply passages 94 and air supply passages 92 are formed by covering the open, lower surfaces of grooves with a covering member, e.g., a resin film 95. The film 95 is fixed to lower end surfaces of ribs 94*c*, 92*c*. The ribs 94*c* define the ink supply passages 94, while the ribs 92*c* define the air supply passages 92. All the ink supply passages 94 and air supply passages 92 of the plurality of mounting places are together covered by a single film 95. This embodiment where the open surfaces of grooves are closed by a covering member to form the air supply passages 92 is advantageous in that air supply passages 92 having a shape including a turn can be formed with a relatively simple structure. Further, since the ink supply passages 94 for the plural ink cartridges 1 are formed using a single covering member, the structure of the mounting portion 3 is simplified, the number of required components is reduced, and the manufacturing thereof is facilitated. Still further, since the single covering member covers not only the plural grooves constituting the air supply passages 92, but also the plural ink supply passages 94, the effects that the structure of the mounting portion 3 is simplified, the number of required components is reduced, and the manufacturing thereof is facilitated, are further significant.

Referring back to FIGS. 2A and 2B, there will be described a state before the ink cartridge 1 is attached to the mounting portion 3 of the inkjet recording apparatus 2, and a state where the ink cartridge 1 is attached thereto.

FIG. 2A shows the state before the ink cartridge 1 is mounted on the mounting portion 3, where the valve members 32, 65 on both of the ink supply side and the air introduction side are respectively pressed onto the valve seats (valve seat surface and valve seat portion) 46*a*, 146*a*, by the elastic force of the support members 46, 146. That is, the valve devices 23, 24 are not opened.

As shown in FIG. 2B, in the state where the ink cartridge 1 is mounted on the mounting portion 3, the valve device 23 is opened by the upper end of the ink drawing tube 12 pushing up the valve member 32 to stretch the side wall portion 36 of the support member 46 so that the valve member 32 is separated from the valve seat surface 46*a*. Consequently, there is formed a path of ink flow from the ink chamber 16 to the ink drawing tube 12 via the ink supply port 21, the opening 37*a* of the valve device 23, the communication passage 58, and between the valve member 32 and the valve seat surface 46*a*. Along this ink passage, the ink is supplied to the recording head 7. According to this arrangement where the valve device 23 as closure means functions to close the ink supply port 21 while the ink cartridge 1 is not mounted on the mounting portion 3, and to bring the ink supply port 21 into communication with the ink drawing tube 12 as a part of an ink drawing portion when the ink cartridge 1 is mounted on the mounting portion 3, the effect that the ink supply port 21 and the ink drawing portion can be brought into communication with each other only by mounting the ink cartridge 1 on the mounting portion 3.

The valve device 24 on the air supply side is opened in the following way. The lower end of the operational part 67 is brought into contact with the bottom of the recess 3*d* to push the valve member 65 upward, stretching the side wall portion 136 of the support member 146, so that the valve part 68 of the valve member 65 is separated from the valve seat portion 146*a* to open the valve device 24.

According to this arrangement, the valve device 24 as closure means function to seal the air introducing port 26 of the ink cartridge 1 from the atmospheric air in a state where the ink cartridge 1 is not mounted on the mounting portion 3, and bring the air introducing port 26 into communication with the air supply port 91 when the ink cartridge 1 is mounted on the mounting portion 3. Therefore, the ink cartridge 1 is closed against the atmospheric air to be free from evaporation of the ink while the ink cartridge 1 is not mounted on the mounting portion 3, and introduction of the atmospheric air into the ink cartridge is enabled by mounting the ink cartridge 1 on the mounting portion 3.

At the same time as the valve device 24 is opened, the sealing portion 63 is fitted in close contact with the recess 3*d* to establish a communication between the air introducing port 26 of the ink cartridge 1 and the air supply port 91 of the mounting portion 3, such that the communication is closed against the outside. Thus, there is formed an air passage from the air intake port 93 of the mounting portion 3 to the upper portion inside the ink chamber 16, via the air supply passage 92, air supply port 91, opening 141 of the valve device 24, clearance between the valve member 65 and the valve seat portion 146*a*, communication passage 158, clearance between the cylindrical part 66 and an opening of the biasing portion 146*b*, air introducing port 26, and the internal passage in the tubular member 25. Through this air passage, the atmospheric air is supplied to the upper inner space of the ink chamber 16. According to this arrangement, the inside of the ink cartridge 1 can communicate with the atmospheric air only via the bend portion of the air supply passage 92, thereby inhibiting evaporation of the ink with reliability.

According to this embodiment, the fitting of the ink drawing tube 12 in the guiding entrance 40 determines the relative position of the valve device 23 to the mounting portion 3, while the position in the bottom of the recess 3*d* at which the operational part 67 is brought into contact with the bottom may be anywhere as long as the operation part 67 does not close the air supply port 91 entirely. This allows relatively great dimensional tolerances between the ink supply port 21 and the air introducing port 26, and between the valve devices 23 and 24 in the ink cartridge 1, and between the ink drawing tube 12 and the air supply port 91 in the mounting portion 3, and facilitates the operation to mount an ink cartridge on the mounting portion by a user.

Figure 6A:
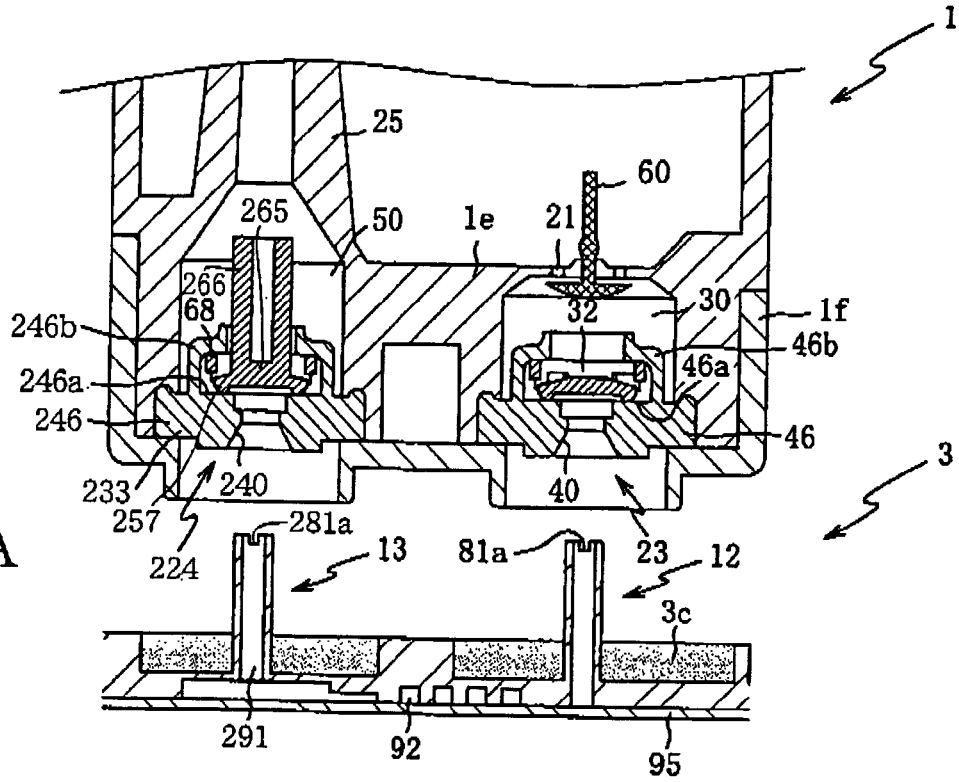
Figure 6B:
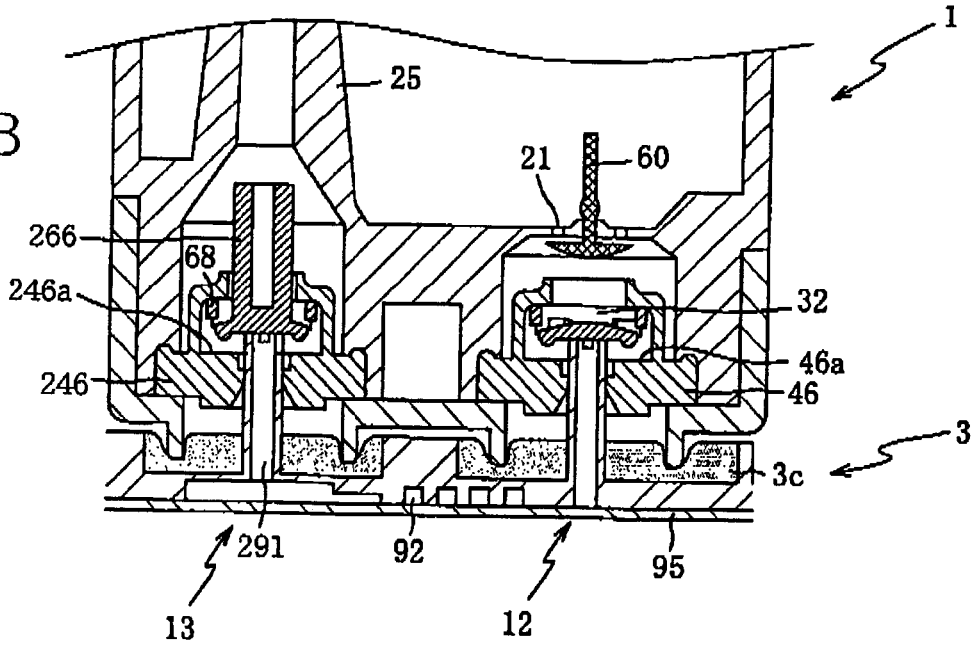

Referring now to FIG. 6, a second embodiment of the invention will be described.

In a mounting portion 3 of the second embodiment, a tube capable of functioning in a similarly way to the operational part 67 of the first embodiment is formed on both of the air introduction side and the ink supply side. That is, the ink supply side of the mounting portion 3 has an identical structure as that of the first embodiment. On the air introduction side, however, there is formed an air supply tube 13, functioning similarly to the ink drawing tube 12, as an operational part pushing up a valve member 265 upon mounting of the ink cartridge 1. This air supply tube 13 is a hollow tubular member having an inner space extending through its entire length, and this inner space constitutes an air supply port 291. A plurality of communication openings 281*a* are formed by cutting an upper end of the air supply tube 13 including an upper end surface at which the air supply tube 13 contacts the valve member 265, so that the atmospheric air is supplied via these communication openings 281*a*. A lower end of the air supply port 291 formed inside the air supply tube 13 is connected to an air supply passage 92, in the same way as the first embodiment.

A support member 246 of a valve device 224 disposed in the communication chamber 50 of the ink cartridge 1 is identical with the support member 46 of the valve device 23. The valve member 265 does not have the operational part 67 under its bottom part 257, unlike the first embodiment, and a cylindrical part 266 is formed on the upper side of the bottom part 257.

In the second embodiment, upon mounting of the ink cartridge 1, the upper end surface of the air supply tube 13 pushes up the valve member 265 to open the valve device 224 on the air introduction side, in the same way as the ink supply side. In a circular bottom wall portion 233 of the support member 246, there is formed a guiding entrance 240. The air supply tube 13 is closely fitted in the guiding entrance 240, and this close fitting between the air supply tube 13 and the guiding entrance 240 provides a sealing arrangement or portion. Thus, a communication between the air supply tube 13 and the air introducing port 26, that is, a communication between the ink cartridge 1 and the bend portion of the air supply passage 92, is ensured, preventing evaporation of the ink with reliability.

Although the presently preferred embodiments of the invention have been described above, the invention is not limited to details of these embodiments, but may be embodied with various improvements and modifications without departing from the spirit and scope of the invention.

For instance, to obtain the effects of the invention, the air supply passage may have any other shapes such as a spiral shape, as long as the shape of the air supply passage includes a turn, that is, a point or part at or along which a change of direction takes place.

Further, although in each of the embodiments valve devices are employed as means for closing the ink supply port 21 and the air introducing port 26, the ports 21, 26 may be closed with rubber members. In a case where rubber members are employed in place of the valve members, an ink supply tube and an air supply tube, each being a hollow needle-like member protruding from the mounting portion, are stuck through the respective rubber members, for instance.

What is claimed is:

1. An inkjet recording apparatus comprising:

a recording head which ejects ink droplets to perform recording;

an ink cartridge which has an ink chamber for storing ink, an ink supply port for supplying the ink to the recording head therethrough, and an air introducing port for introducing an atmospheric air into the ink chamber therethrough;

a mounting portion on which the ink cartridge is detachably mountable, and which has an ink supply portion for supplying the ink drawn from the ink cartridge to the recording head, and an air introduction portion for supplying the atmospheric air into the ink chamber;

wherein the air introduction portion comprises: an air supply port disposed to positionally correspond to the air introducing port of the ink cartridge when the ink cartridge is mounted on the mounting portion; an air intake port for taking in the atmospheric air therethrough; and an air supply passage which extends between the air supply port and the air intake port and whose shape comprises a turn, and wherein the air supply passage of the air introduction portion comprises: a groove formed in a first one of opposite surfaces of a wall member constituting the mounting portion; and a covering member which is fixed to the wall member to cover an open surface of the groove.

2. The inkjet recording apparatus of claim 1, wherein the air supply passage is labyrinthine.

3. The inkjet recording apparatus of claim 2, wherein the air supply passage includes multiple turns in close proximity.

4. The inkjet recording apparatus of claim 1, wherein the ink cartridge is mountable on a second one of the opposite surfaces of the wall member of the mounting portion, and the air supply port is formed through the wall member to be in communication with one of opposite ends of the groove of the air supply passage.

5. The inkjet recording apparatus of claim 4, wherein the air intake port is formed through the wall member to be in communication with the other end of the groove.

6. The inkjet recording apparatus of claim 5, wherein the air intake port has an opening in the second surface of the wall member, and the opening is covered by an elastic porous material allowing an air communication and extending around the ink supply portion of the mounting portion.

7. The inkjet recording apparatus of claim 4, wherein the air supply port is open in the second surface of the wall member, the apparatus further comprising a sealing member which is disposed between the ink cartridge and the mounting portion when the ink cartridge is mounted on the mounting portion, the sealing member establishing communication between the air introducing port of the ink cartridge and the air supply port of the mounting portion such that the two ports are sealed from the outside.

8. The inkjet recording apparatus of claim 7, wherein the ink cartridge has closure means which closes the air introducing port from the atmospheric air in a state where the ink cartridge is not mounted on the mounting portion, and establishes the communication between the air introducing port and the air supply port when the ink cartridge is mounted on the mounting portion.

9. The inkjet recording apparatus of claim 8, wherein the closure means has a valve member and a valve seat portion which is formed of an elastic material and on which the valve member is seated, and the sealing member is connected to the valve seat portion.

10. The inkjet recording apparatus of claim 9, wherein the valve member includes a protrusion which is brought into contact with the second surface of the wall member, when the ink cartridge is mounted on the mounting portion, so that the valve member is separated from the valve seat portion and the air introducing port is communicated with the air supply port, the protrusion not entirely closing the air supply port when brought into contact with the second surface.

11. The inkjet recording apparatus of claim 7, wherein the air supply port is constituted by an inner space extending through a tube protruding from the second surface of the wall member, the tube being inserted in the air introducing port when the ink cartridge is mounted on the mounting portion, and wherein the sealing member is interposed between an outer surface of the tube and the air introducing port.

12. The inkjet recording apparatus of claim 4, wherein the mounting portion has an integrally formed plurality of mounting places on each of which the ink cartridge is detachably mountable, the mounting places being arranged in a row on the second surface of the wall member, and wherein the groove constituting the air supply passage of the air introduction portion is formed in the first surface of the wall member at a position corresponding to each of the mounting places, and the covering member extends across the mounting places to cover the open surfaces of the respective grooves.

13. The inkjet recording apparatus of claim 12, comprising a plurality of the recording heads, and wherein the ink supply portion is provided on the second surface of the wall member at each of the mounting places, wherein a plurality of ink supply passages are formed in the first surface of the wall member, and one of the opposite ends of each of the ink supply passages is connected to a corresponding one of the ink supply portions while the other end of the each ink supply passage is connected to a corresponding one of the recording heads, and wherein the covering member is fixed to the wall member to cover the open surfaces of the grooves of the air supply passages, and open surfaces of the ink supply passages.

14. The inkjet recording apparatus of claim 1, wherein the ink cartridge comprises closure means which closes the ink supply port in a state where the ink cartridge is not mounted on the mounting portion, and opens the ink supply port to establish communication between the ink supply port and the ink supply portion when the ink cartridge is mounted on the mounting portion.

15. The inkjet recording apparatus of claim 1, comprising a main body, and wherein the mounting portion is disposed at a stationary part in the main body, and the ink supply portion and the recording head is connected by means of an ink supply pipe.

* * * * *